United States Patent [19]

Williams et al.

[11] 3,935,674

[45] Feb. 3, 1976

[54] SLIDING VEHICLE DOOR

[75] Inventors: Alverson B. Williams, Warren; Bolek J. Dolinski, St. Clair Shores; Sam S. Pupillo, Roseville, all of Mich.

[73] Assignee: General Motors Corporation, Detroit, Mich.

[22] Filed: July 15, 1974

[21] Appl. No.: 488,546

[52] U.S. Cl. ..... 49/212; 49/216; 49/223

[51] Int. Cl.[2] ..... E05D 15/10

[58] Field of Search ..... 49/221, 223, 218, 216, 49/209, 212

[56] References Cited

UNITED STATES PATENTS

| | | | |
|---|---|---|---|
| 2,445,131 | 7/1948 | Wartian | 49/212 |
| 3,051,999 | 9/1962 | Schimek | 49/216 |
| 3,075,803 | 1/1963 | Wilfert | 49/212 |

*Primary Examiner*—Kenneth Downey
*Attorney, Agent, or Firm*—H. Furman

[57] ABSTRACT

A sliding vehicle door has a guard beam therein having flanges at its upper and lower edges. An extruded carriage member is associated with each of the flanges and slidably engages the flange to permit longitudinal movement of the guard beam and the door on the carriage member. A hinge arm is associated with each of the extruded carriage members and has one end pivoted to the carriage member and the other end pivoted to a body pillar defining the door opening. An articulating link acts between the body pillar and one of the carriage members to maintain the door in substantial parallel relationship with the vehicle longitudinal axis during pivotal movement of the hinge arms to move the door laterally of the body between a closed position in the plane of the door opening and an open position laterally outboard of the door opening. A first interlock arrangement acts between one of the hinge arms and the guard beam to assure completed lateral movement of the door prior to longitudinal sliding movement of the door. A second interlocking acts between the hinge arm and its associated carriage member to prevent lateral inboard movement prior to completed sliding movement of the door to its normal closed position on the carriage member.

1 Claim, 5 Drawing Figures

SLIDING VEHICLE DOOR

The invention relates to a vehicle door and more particularly to a hinge device for a sliding vehicle door.

It is known to provide a vehicle door mounted by a hinge arrangement which upon opening movement first moves the door laterally outboard the plane of the door opening and then permits longitudinal sliding movement of the door to an open position permitting passenger ingress and egress.

It is also known to provide an interlock which prevents fore and aft sliding movement of the door relative the vehicle body until the door is moved fully laterally outboard of the door opening.

The present invention provides an improved mounting arrangement for such a sliding vehicle door and in particular provides an improved interlocking latch arrangement for coordinating the lateral and longitudinal modes of door movement. Furthermore, a door according to the invention has a strengthening guard beam having flanged upper and lower edges which provide integral guide tracks for the fore and aft sliding mode of door movement.

The invention is utilized in a conventional vehicle body having a door opening defined by longitudinally spaced body pillars. The door has a guard beam therein which, when the door is closed, is effective to reinforce the vehicle door. The guard beam has integrally formed vertically spaced flanges at its upper and lower edges which provide integral guide tracks extending longitudinally of the door. An extruded carriage member is associated with each of the guide tracks and slidably engages the associated guide track to permit longitudinal movement of the door on the carriage members. A hinge arm is associated with each carriage member and has its ends respectively pivoted to the carriage member and the rearward body pillar. An articulating link acts between the body pillar and at least one of the carriage members to maintain the door in substantial parallel relationship with the vehicle longitudinal axis during pivoting movement of the hinge arms to move the door laterally of the body between the closed position in the plane of the vehicle body door opening and the open position laterally outboard of the body. An interlock tab on one of the hinge arms remains engaged within an aperture in the guard beam until the door is moved laterally to its fully open laterally outboard position, thereby preventing rearward sliding movement of the door on the carriage member until the door is moved fully outboard of the plane of the door opening. A second interlock latch includes a spring biased latch lever which is engageable in aligned apertures of one of the carriage members and its associated hinge arm to thereby prevent pivoting movement of the carriage member on the hinge arm. An abutment on the door moves the spring biased latch lever to its unlocked position whenever the door is in its fully forward position with respect to the carriage member and accordingly poised for lateral movement between open and closed positions.

One feature of the invention is the provision of a guard beam in a vehicle door having flanges which provide integral tracks for permitting fore and aft sliding movement of the vehicle door.

Another feature of the invention is an interlock device for an articulated sliding door which assures completed lateral movement of the door prior to longitudinal sliding movement and prevents lateral inboard movement prior to completed sliding movement of the door to its normal longitudinal position.

These and other features and advantages of the invention will become apparent upon consideration of the specification and appended drawings in which.

Figure 1:
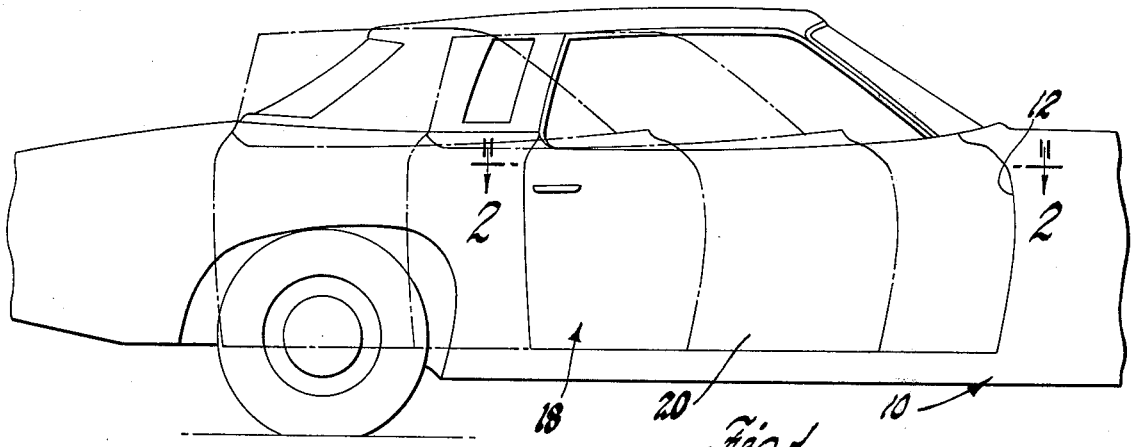
FIG. 1 is a side elevation view of a vehicle body having a sliding door according to the invention.
Figure 2:
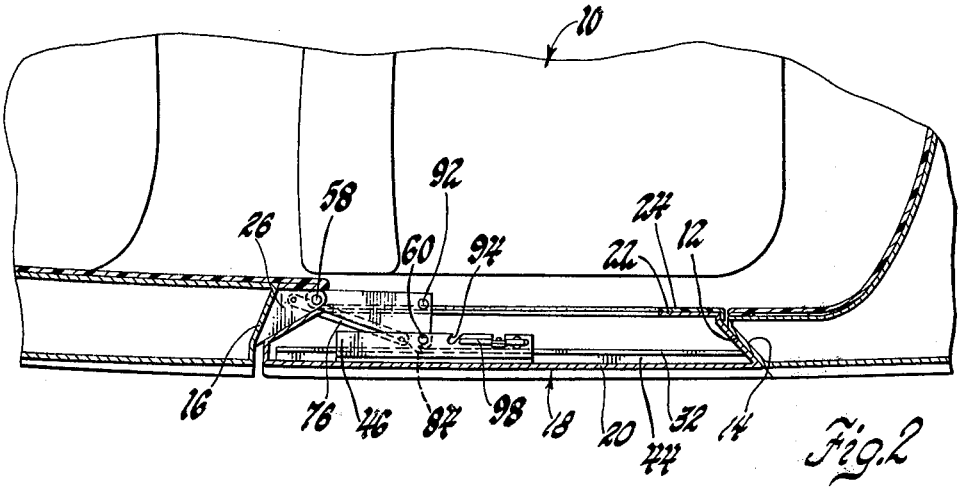
FIG. 2 is a sectional view taken in the direction of arrows 2—2 of FIG. 1 and showing the door in closed position.
Figure 3:
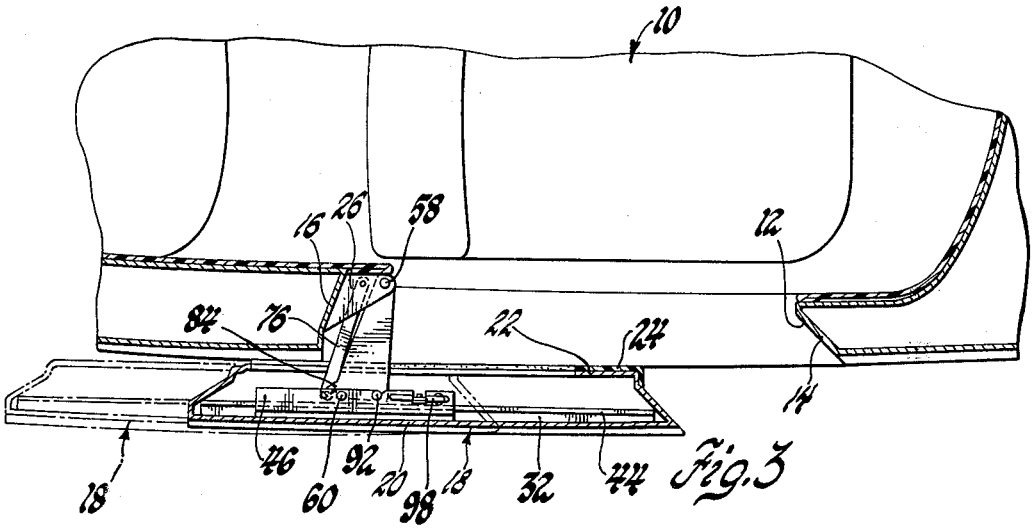
FIG. 3 is a view similar to FIG. 2 but showing the door in partially open position.

Referring to FIG. 1 a conventional vehicle body is indicated generally at 10. The vehicle body 10 has a door opening 12 which is defined at its forward edge by a forward pillar 14 and at its rearward edge by a rearward pillar 16 as seen in FIGS. 2 and 3. A door 18 is provided for closure of the door opening 12 and includes an outer panel 20 and an inner panel 22. The inner panel 22 is covered with a conventional trim panel 24.

Figure 4:
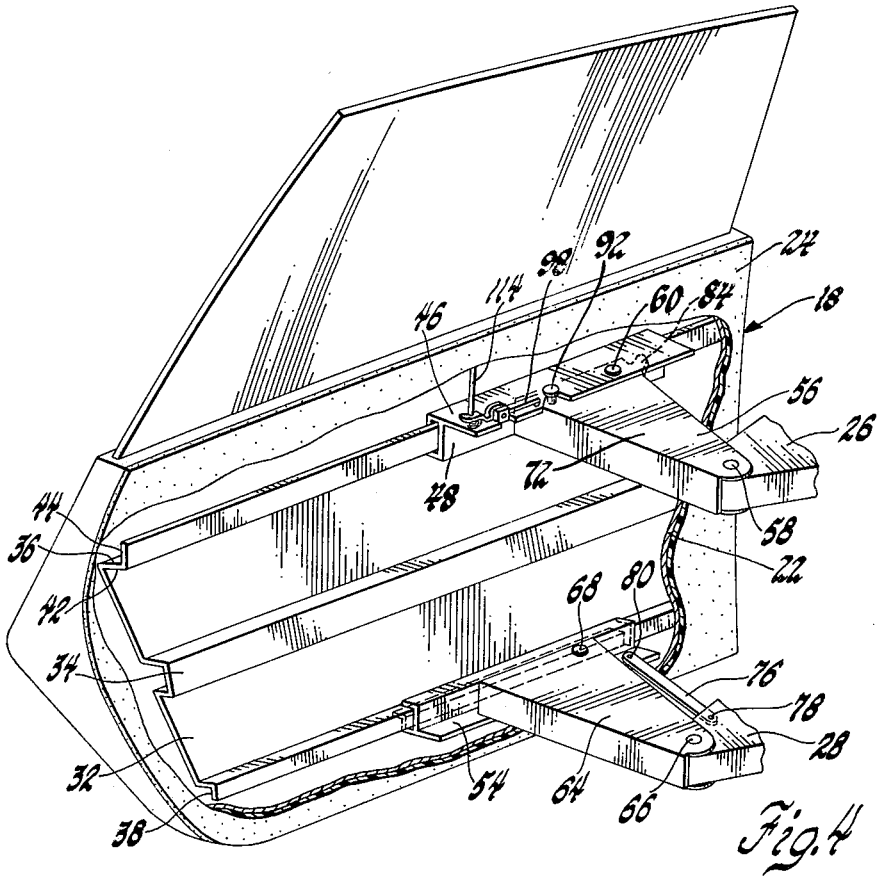
FIG. 4 is a perspective view showing the vehicle door.

Referring to FIGS. 2 and 4 it will be seen that hinge pillar brackets 26 and 28 are attached to and extend from the rearward pillar 16 of the vehicle body 10. The hinge pillar brackets 26 and 28 are vertically spaced on the pillar 16 as shown in FIG. 4.

Referring to FIG. 4, the door 18 has a guard beam 32 which is conventionally mounted therein as by welding and which extends the length of the door. The guard beam 32 has a rib 34 at its center, a flange 36 at its upper edge portion and a flange 38 at its lower edge portion. The rib 34 and flanges 36 and 38 serve to strengthen the guard beam 32.

Figure 5:
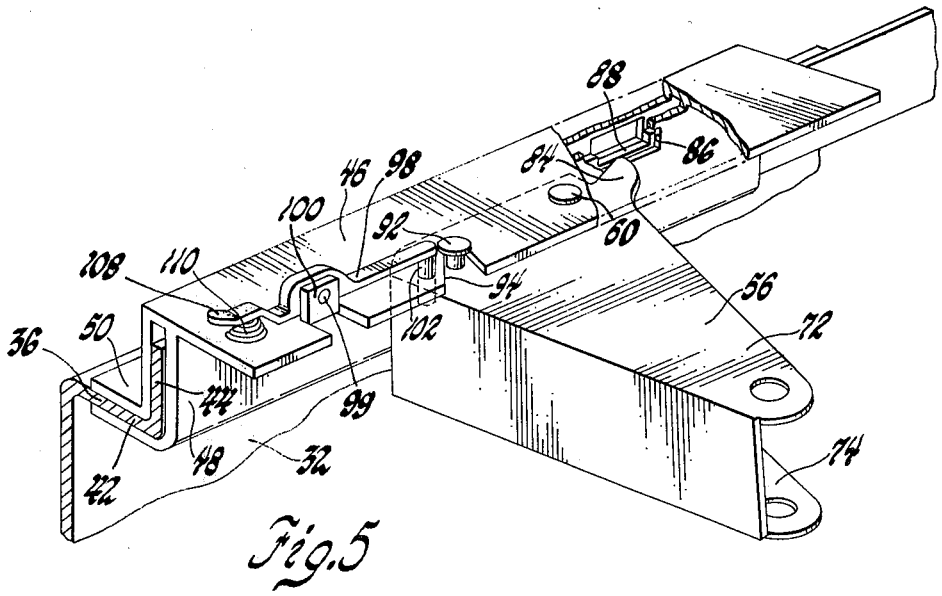
FIG. 5 is an enlarged fragmentary view of FIG. 4.

As best seen in FIG. 4 and 5, the invention provides a mechanism for mounting the door 18 on the vehicle body 10. The flange 36 at the upper edge of the guard beam 32 includes an inwardly directed leg 42 and a vertical leg 44 extending upwardly from the inwardly directed leg 42. An elongated extruded carriage member 46 captures and slidably engages the flange 36. The carriage member 46 has an inboard leg 48 and an outboard leg 50 each of which has downwardly depending and outwardly directed portions which closely surround and slidably engage the vertical leg 44 and inwardly directed leg 42 of the flange 36. Thus it is seen that the stiffening flange 36 of the guard beam 32 provides an integral track which is slidably interengaged with the elongated extruded carriage member 46 to permit fore and aft sliding movement of the door relative the carriage member 46. A similar elongated extruded carriage member 54 similarly slidably engages the flange 38 at the lower edge portion of the guard beam 32.

A channel hinge arm 56 extends between the hinge pillar bracket 26 and the carriage member 46. One end of the hinge arm 56 is pivoted to the hinge pillar bracket 26 by a pivot pin 58 while the other end of the hinge arm 56 is pivoted to the carriage member 46 by a pivot 60. A similar channel hinge arm 64 has its one end pivoted to hinge pillar bracket 28 by pivot pin 66 and its other end pivoted to the carriage member 54 by a pivot 68. As best seen in FIG. 5, the hinge arms 56 and 64 are stampings having vertically spaced flanges 72 and 74 which impart load bearing capability to the hinge arms sufficient to support the weight of the door 18 in cantilevered fashion.

As seen in FIG. 4, an articulating link 76 extends in parallel relation to an axis through the pivots 66 and 68 of the hinge arm 64. The articulating link has its ends respectively pivoted to the hinge pillar bracket 28 and the carriage member 54 by pivots 78 and 80. The articulating link 76 is effective to coordinate pivoting movement of the hinge arms relative the hinge pillar brackets and carriage members to maintain the door 18 in parallel relation to the longitudinal axis of the vehicle body.

Referring to FIG. 2, the door is shown in the normal closed position in which door 18 is located within the plane of the door opening 12. The door is opened moved to open position by two sequential modes of opening movement, the first being movement laterally outboard of the door opening 12 the solid line position of FIG. 3 followed by rearward movement of the door 18 to the phantom line position of FIG. 3. The first sequence of opening movement is provided by pivotal movement of the hinge arms 56 and 64 relative their respective hinge pillar brackets 26 and 28 and carriage members 46 and 54. The articulating link 76 maintains the door 18 parallel to the longitudinal axis of the vehicle body during such pivoting movement. The door 18 is thus moved from the position of FIG. 2 with an accompanying component of rearward motion, to the position of FIG. 3 in which the door 18 is positioned entirely outboard the door opening 12. The second mode of door opening movement is the rearward sliding of the door 18 to the phantom line position of FIG. 3. This rearward sliding movement is provided by sliding movement of the flanges 36 and 38 of the guard beam 32 within the carriage members 46 and 54.

As best seen in FIGS. 3 and 5, the hinge arm 56 has an interlock hook 84 extending therefrom. When the door is in the closed position of FIG. 2 the interlock hook 84 extends through an aperture 86 of the leg 48 of the carriage member 46 and into an aligned slot 88 of the guard beam flange 36. In this manner the interlock tab 84 prevents sliding movement of the door 18 relative the carriage member 46. As the door approaches its fully outboard position of FIG. 3 the interlock hook 84 is withdrawn from the apertures 86 and 88 so as to permit initiation of sliding movement of the door 18 on the carriage member 46. In this manner the interaction between the interlock hook 84 of the hinge arm 56 and the aperture 88 of the guard beam 32 cooperate to assure completed lateral movement of the door 18 prior to initiation of the longitudinal sliding movement of the door. A stop pin 92 mounted on the hinge arm 56 is engaged within a recess 94 of carriage member 46 to terminate pivotal movement of the hinge arm 56 and thereby stop the door 18 at its fullest lateral outboard position.

A second interlock mechanism is provided to assure completed sliding movement of the door to its normal longitudinal position on the carriage members prior to initiation of lateral inboard movement to close the door. The interlock includes a latch lever 98 which is pivoted by pivot 99 to an upstanding tab 100 of the carriage member 46. One end of the latch lever 98 has a depending plunger 102 which extends through aligned apertures of the carriage member 46 and hinge arm 56. The other end of the latch lever 98 has a ramped cam surface 108. The latch lever 98 is biased by a coil compression spring 110 to its position of FIG. 5 in which plunger 102 extends through the aligned apertures of carriage member 46 and hinge arm 56 to lock the carriage member 46 and hinge arm 56 in their relative pivotal positions in which the door 18 is located in its fully outboard position. When the door 18 is slid forwardly on the carriage members to its solid line position of FIG. 3, an actuating member 114 mounted on the door engages the ramped cam surface 108 of lever 98 to bias the lever 98 against spring 110 and lift the plunger 102 from the apertures of the hinge arm 56. Withdrawal of the plunger 102 from the aperture in the hinge arm 56 permits initiation of lateral inboard movement of the door by permitting pivotal movement of the hinge arm 56 relative the vehicle body and the door 18. During the initial increment of such pivotal movement the interlock hook 84 enters slots 86 and 88 to prevent the door from sliding relative the carriage member 46.

Thus it is seen that the invention provides an improved sliding door for a vehicle body.

What is claimed is:

1. In a vehicle body having a door opening defined by longitudinally spaced body pillars and a door for selectively opening and closing the door opening, means for mounting the door comprising: a guard beam mounted in the door and effective to reinforce the door and transmit force applied against the door to the body pillars, the guard beam having a pair of integral longitudinally extending vertically spaced flanges at the upper and lower edges thereof, a pair of extruded carriage members, each extruded carriage member having flanges for slidably capturing the flanges of the guard beam to support the door and permit longitudinal fore and aft sliding movement of the door on the extruded carriage members between a normal position on the carriage member cooresponding to door closed position and an open position, a pair of hinge arms each being associated with one of the extruded carriage members and each having one end pivoted to one of the body pillars and the other end pivoted to the associated extruded carriage member to permit movement of the extruded carriage member and the door between a closed position closing the door opening and an open position in which the extruded carriage members are moved laterally outboard of the door opening, a first latch means acting between one of the hinge arms and the guard beam and including hook means carried on the hinge arm and slot means in the guard beam, the hook means normally extending into the slot means to lock the door from sliding movement and being withdrawn from the slot means to permit sliding movement when the hinge arm and carriage member reach their relative pivotal positions in which the carriage member and door are moved fully laterally outboard of the door opening, and second latch means acting to prevent lateral inboard movement of the door until the door has been moved on the carriage member to its normal position thereon, said latch means including a spring biased latch lever which is normally engageable in aligned apertures of one of the carriage members and its associated hinge arm to thereby prevent pivoting movement of the carriage member on the hinge arm, and an abutment mounted on the door and engageable with the spring biased latch lever to move the spring biased latch lever to its unlatched position whenever the sliding movement position of the door corresponds to the door closed position on the carriage members.

* * * * *